US010414641B2

(12) United States Patent
Sanchez et al.

(10) Patent No.: US 10,414,641 B2
(45) Date of Patent: Sep. 17, 2019

(54) DEVICE FOR UNCORKING A BOTTLE OF A PRESSURISED LIQUID SUCH AS A BOTTLE OF CHAMPAGNE

(71) Applicants: Aymerick Sanchez, Boulogne Billancourt (FR); Guillaume Cazaudehore, Paris (FR)

(72) Inventors: Aymerick Sanchez, Boulogne Billancourt (FR); Guillaume Cazaudehore, Paris (FR)

( * ) Notice: Subject to any disclaimer, the term of this patent is extended or adjusted under 35 U.S.C. 154(b) by 0 days.

(21) Appl. No.: 15/578,770

(22) PCT Filed: Jun. 7, 2016

(86) PCT No.: PCT/FR2016/051351
§ 371 (c)(1),
(2) Date: Dec. 1, 2017

(87) PCT Pub. No.: WO2016/203133
PCT Pub. Date: Dec. 22, 2016

(65) Prior Publication Data

US 2018/0155174 A1 Jun. 7, 2018

(30) Foreign Application Priority Data

Jun. 19, 2015 (FR) ..... 15 55658

(51) Int. Cl.
*B67B 7/06* (2006.01)
*A63H 37/00* (2006.01)

(52) U.S. Cl.
CPC ..... *B67B 7/066* (2013.01); *A63H 37/00* (2013.01)

(58) Field of Classification Search
CPC ..... B67B 7/066; B67B 7/06; A63H 37/00
(Continued)

(56) References Cited

U.S. PATENT DOCUMENTS 4,442,735 A * 4/1984 Chance ..... B67B 7/066 215/272
4,520,696 A 6/1985 Wolze ..... 81/3.55
(Continued)

FOREIGN PATENT DOCUMENTS

DE 93 12 253 U1 12/1993
DE 9312253 U1 * 12/1993 ..... A47G 21/00
(Continued)

OTHER PUBLICATIONS

International Search Report dated Aug. 22, 2016 in corresponding PCT International Application No. PCT/FR2016/051351.
(Continued)

*Primary Examiner* — Hadi Shakeri
(74) *Attorney, Agent, or Firm* — Ostrolenk Faber LLP

(57) ABSTRACT

A device for uncorking a bottle of a pressurised liquid such as a bottle of champagne. The device includes a hollow main body with a substantially cylindrical cross-section, with a lower portion including an opening allowing the neck of the bottle to pass therethrough and a profile capable of snap-fitting the lower portion onto the collar of the bottle, an intermediate portion making it possible to grip the device and guide the ejected cork into the main body, and an upper portion including means for trapping the ejected cork so as to make it possible to trap and retain the cork after extracting same.

9 Claims, 2 Drawing Sheets

(58) Field of Classification Search
USPC ..... 81/3.08
See application file for complete search history.

(56) References Cited

U.S. PATENT DOCUMENTS

| | | | | | |
|---|---|---|---|---|---|
| 5,117,995 | A * | 6/1992 | Kau | B65D 39/00 | 116/281 |
| 5,433,644 | A * | 7/1995 | Cheng | A63H 37/00 | 446/183 |
| 5,544,551 | A * | 8/1996 | Marcorin | B67B 7/066 | 81/3.29 |
| 9,409,100 | B2 * | 8/2016 | Hillery | A63H 37/00 | |
| 2005/0139040 | A1 | 6/2005 | Crudgington, Jr. | 81/3.55 | |
| 2008/0141830 | A1 * | 6/2008 | Mauffette | B67B 7/066 | 81/3.08 |
| 2013/0233821 | A1 | 9/2013 | Golden | 215/228 | |
| 2015/0360140 | A1 * | 12/2015 | Hillery | A63H 37/00 | 446/475 |

FOREIGN PATENT DOCUMENTS

| | | | | |
|---|---|---|---|---|
| DE | 296 20 491 | U1 | 1/1997 | |
| DE | 29620491 | U1 * | 1/1997 | B67B 7/066 |
| DE | 198 23 336 | A1 | 12/1999 | |
| DE | 19823336 | A1 * | 12/1999 | A63H 37/00 |
| DE | 199 40 734 | A1 | 3/2001 | |
| DE | 19940734 | A1 * | 3/2001 | B67B 7/066 |
| EP | 0 664 274 | A1 | 7/1995 | |
| FR | 2 828 681 | A1 | 2/2003 | |
| WO | WO 2006/092661 | A1 | 9/2006 | |

OTHER PUBLICATIONS

Written Opinion dated Aug. 22, 2016 in corresponding PCT International Application No. PCT/FR2016/051351.

* cited by examiner

DEVICE FOR UNCORKING A BOTTLE OF A PRESSURISED LIQUID SUCH AS A BOTTLE OF CHAMPAGNE

CROSS-REFERENCE TO RELATED APPLICATIONS

The present application is a 35 U.S.C. §§ 371 national phase conversion of PCT/FR2016/051351, filed Jun. 7, 2016, which claims priority to French Patent Application No. 1555658, filed Jun. 19, 2015, the contents of which are incorporated herein by reference. The PCT International Application was published in the French language.

TECHNICAL FIELD

The present invention concerns a device for uncorking a bottle of a pressurized liquid such as a champagne bottle.

Although particularly adapted for uncorking champagne bottles, the invention may also be used for the uncorking of other types of bottle equipped with a cork and containing a pressurized liquid and in particular, by way of example, bottles of ciders.

PRIOR ART

The uncorking of a champagne bottle is a delicate operation, indeed the pressure in the bottle is generally in the order of 5 bars, and the pressure exerted by the carbon dioxide increases in the neck of the bottle during the uncorking such that the cork can be ejected at a speed greater than 50 km/h.

It is common to uncork the bottle by manually retaining the cork, nevertheless a poor control or the non-retaining of said cork may cause significant damage.

In order to avoid this drawback, many types of devices have been considered and in particular a safety system provided for in the document FR2828681 consisting of a ring held by the user and fastened on the other hand to the cork so as to prevent the disengagement of the cork after removal. However, this solution results in drawbacks, in particular, a risk of injury to the user's hand and also requires bottles having the original system equipment.

There are also known systems allowing the removal of the cork in a safe manner for the hand of the user, but which do not allow retaining effectively the cork and for example, from the document U.S. Pat. No. 4,520,696, a fork-shaped system allowing to bear on the rim of the bottle and to raise the cork until ejection.

There are also known systems allowing both the removal of the cork and the holding thereof and in particular a clamp as provided in the document US2005/0139040 including jaws and a stopper member of the cork.

However, these systems are not satisfactory in this sense that they do not allow a free ejection of the cork out of the neck before the holding thereof. In this type of system, the user absorbs the shock of the cork via the clamp, furthermore, the removal of the set formed by the clamp and the cork is not easy. Finally, the cork is stopped in the propulsion thereof, but is not retained afterwards by the system.

OBJECT OF THE INVENTION

A first aim of the present invention is to solve all or part of the technical problems related to the aforementioned prior art.

Another aim of the present invention is to provide an uncorking device allowing the damping and the holding of the cork.

Another aim of the present invention is to propose an uncorking device which may be adapted to the uncorking of any type of champagne bottle.

Another aim of the present invention is to propose an uncorking device allowing to avoid any risk of accident due to the ejection of the cork.

Another aim of the present invention is to propose an uncorking device allowing to serve the bottle without removing the device.

Another aim of the present invention is to propose an uncorking device allowing to release decorative elements during the ejection of the cork.

SUMMARY OF THE INVENTION

To this end, the uncorking device of a bottle of a pressurized liquid such as a champagne bottle comprises, according to the invention, a hollow main body of a substantially cylindrical section with:

- a lower portion including an opening allowing the passage of the mouth of the bottle and a profile capable of clipping the lower portion on the ring of the bottle,
- an intermediate portion allowing the grasping of the device and the guiding of the cork ejected into the main body and,
- an upper portion including means for damping the ejected cork so as to allow the damping and the retaining of the cork after the extraction thereof.

BRIEF DESCRIPTION OF THE FIGURES

The present invention will be better understood upon reading a detailed embodiment with reference to the appended figures, provided by way of non-limiting example, among which.

DETAILED DESCRIPTION OF THE INVENTION

Figure 1:
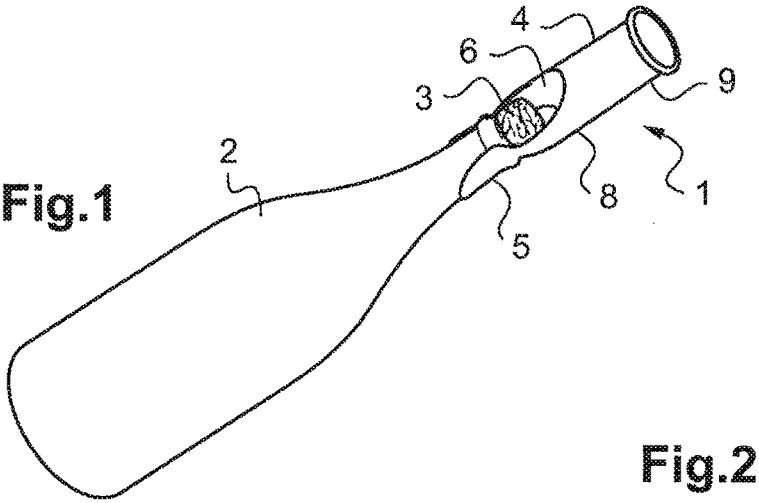
FIG. 1 represents a schematic embodiment in perspective of an uncorking device, in accordance with the invention, placed on a bottle.

Mainly, with reference to FIG. 1, an uncorking device 1 is shown, in schematic form.

This device 1 is placed on a bottle of a pressurized liquid 2. This bottle 2 is closed by a cork 3 conventionally made in the form of a mushroom from which the wire cap has been previously removed.

This uncorking device 1 comprises a hollow main body 4 of a substantially cylindrical section with three portions. The section of the main body 4 has an inner diameter in the order of 32 to 45 mm allowing to receive a champagne cork, the standard diameter for a champagne bottle cork being of 31 mm.

This main body 4 comprises a lower portion 5 which is fastened on the top of the bottle 2.

To do this end, the lower portion 5 includes an opening 6 allowing the passage of the mouth of the bottle 2 and a profile 7 capable of clipping the lower portion 5 onto the ring of the bottle 2.

Figure 2A:
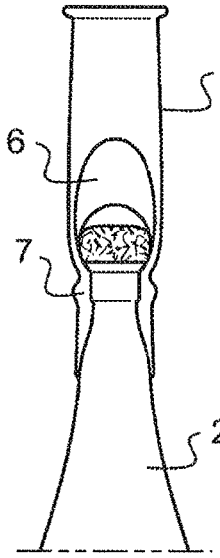
FIGS. 2*a*, 2*b* and 2*c* show partial side views of the set uncorking device and bottle shown in FIG. 1.
Figure 2B:
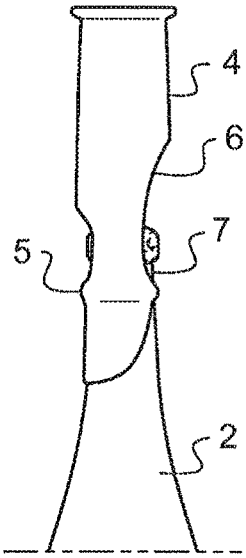
Figure 2C:
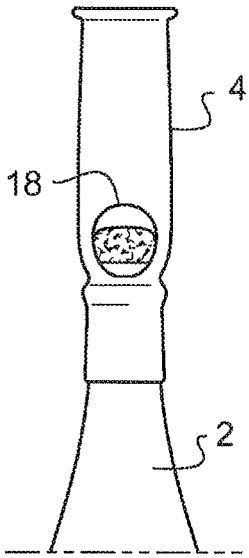

With reference to FIGS. 2*a*, 2*b* and 2*c*, showing partial side views of the set uncorking device 1 and bottle 2, the profile 7 of the lower portion 5 and the link between the lower part 5 and the bottle 2 are in particular shown.

The profile 7 further allows lifting and extracting the cork 3 by bearing on the ring of the bottle. To this end, after having positioned the device 1 on the bottle 2, the user performs a pushing movement toward the top of the device 1 with his hand positioned on the device 1 while holding the bottle 2 with the other hand or preferably by imparting a rotational movement thereto. In this manner, the cork 3 is ejected inside the main body 4.

In a variant, the profile 7 allows holding the uncorking device 1 on the bottle 2 but the pressure to make the cork 3 come out is exerted directly by the user who passes at least one finger through the opening 6 in order to press with said finger in order to eject the cork 3.

The main body 4 further comprises an intermediate portion 8 allowing the grasping of the device 1 and the guiding of the cork 3 ejected in the main body 4. The ejected cork 3 thus moves upwards along the main body 4 towards an upper portion 9.

This upper portion 9 including means 10 for damping the ejected cork 3. These are the damping means 10 which ensure the damping and the retaining of the cork 3 after the extraction thereof.

According to an advantageous aspect, the main body 4 is made of a deformable material allowing a good contact between the lower portion 5 and the neck of the bottle 2. It may also be advantageous to make the main body 4 of a starch-based polymer.

Figure 3:
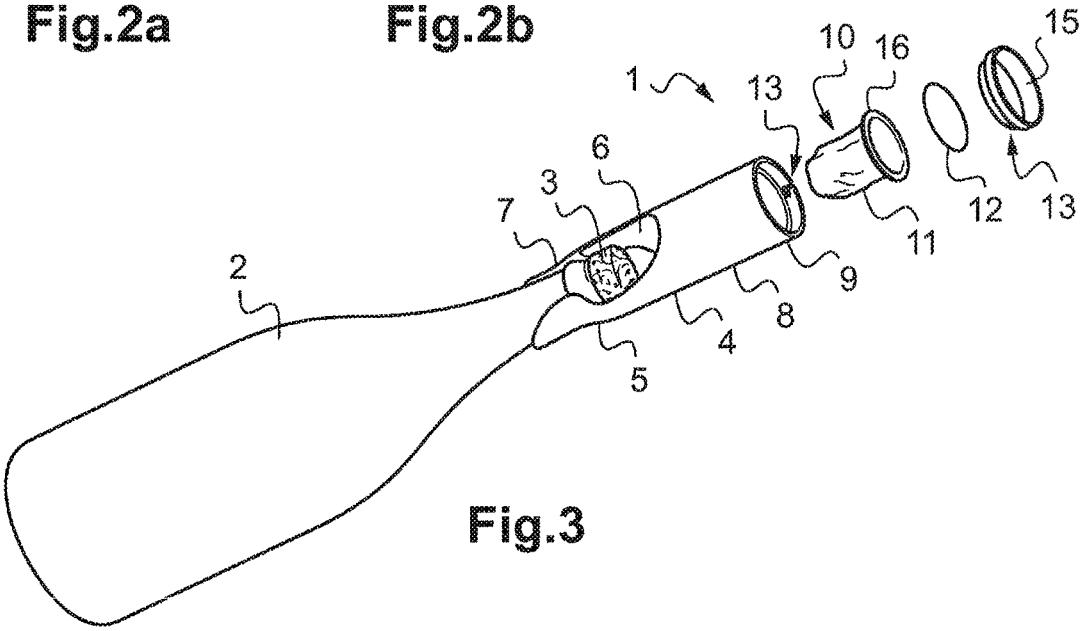
FIG. 3 shows an exploded perspective view of the device shown in FIG. 1, FIGS. 4*a*, 4*b*, 4*c*, 4*d* show sectional views of the set uncorking device and bottle during the different ejection phases of the cork.

This time, mainly with reference to FIG. 3 showing an exploded view of the device 1 placed on a bottle 2, the damping means 10 are shown including a deformable damping pocket 11.

This deformable pocket 11 is disposed in the main body 4 on the ejection path of said cork and the deformation thereof is performed in the main axis direction of the main body 4.

In the embodiment of the appended figures, the deformable damping pocket 11 is a flexible pocket equipped with a seal 12 opposite the point of impact of the cork 3.

This seal 12 is tearable, which allows releasing the content of the damping pocket 11 during the impact of the cork 3 on said damping pocket.

In order to facilitate the breakage, at least one break line is advantageously provided at the seal 12, which allows the tearing thereof at the moment of the impact of the cork 3.

This being in another embodiment, it is provided that the seal 12 is made of a weak film which does not require break lines to be teared at the moment of the impact of the cork 3.

In order to allow the retaining of the pocket 11 and the cork 3, blocking means 13 are provided.

These blocking means 13 include a rim 14 formed in the inner wall of the main body 4 and a retaining ring 15 between which the collar 16 of the damping pocket 10 is held.

Advantageously, the retaining ring 15 is fastened to the main body 4 in a removable link and for example with a bayonet-type fastening as seen in FIG. 3.

With reference this time to FIGS. 4*a* to 4*d*, the arrangement of the different components of the blocking means 13 is in particular seen.

Figures 4A, 4B, 4C, 4D:
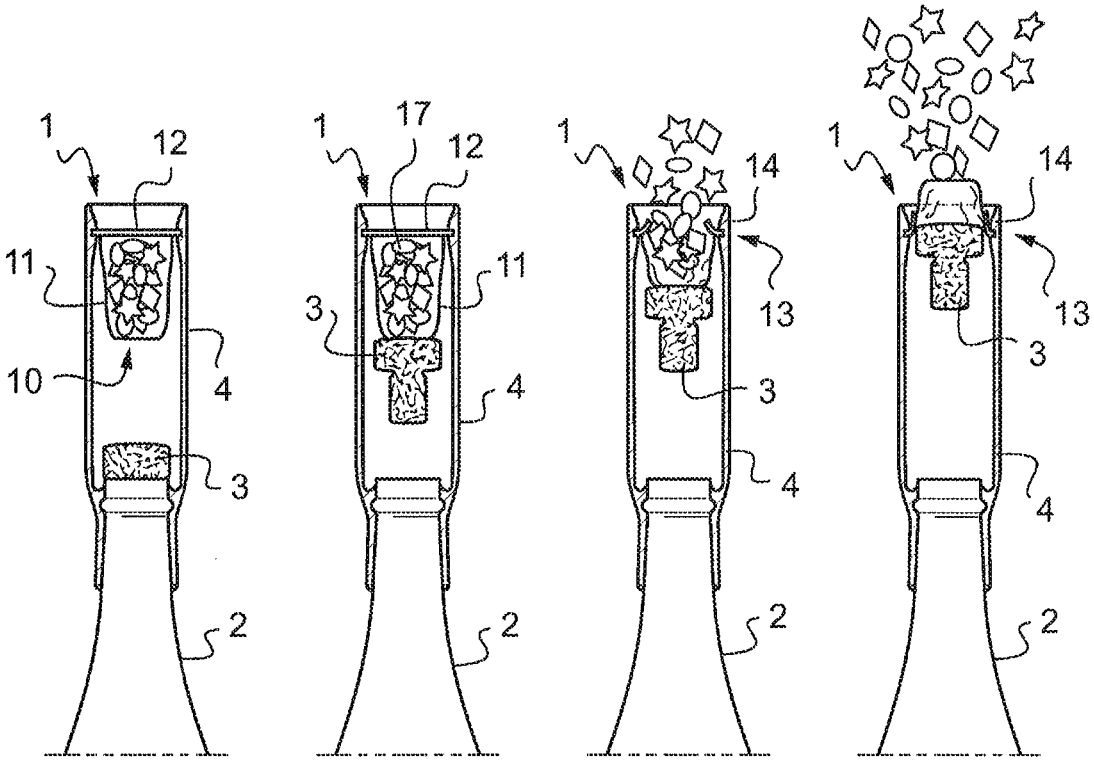

The different ejection phases of the cork 3 are also seen between the initial position shown in FIG. 4*a* then, successively the exiting from the mouth of the bottle 2 shown in FIG. 4*b*, the percussion of the cork on the pocket 11 shown in FIG. 4*c* then finally the retaining thereof at the pocket shown in FIG. 4*d*.

The breakage of the seal 12 is also seen following the impact of the cork 3 in FIG. 4*c*.

In this regard, ejectable materials 17 in particular of a confetti type are provided in the damping pocket 11. These ejectable materials 17 are propelled into the air at the moment of the breakage of the seal 12 giving a festive aspect to the uncorking of the bottle 2. In a variant, ejectable articles, in particular of minimal weight, are placed in the damping pocket 11 to be able to be projected out of the pocket 11 by the percussion of the cork 3.

Figure 5:
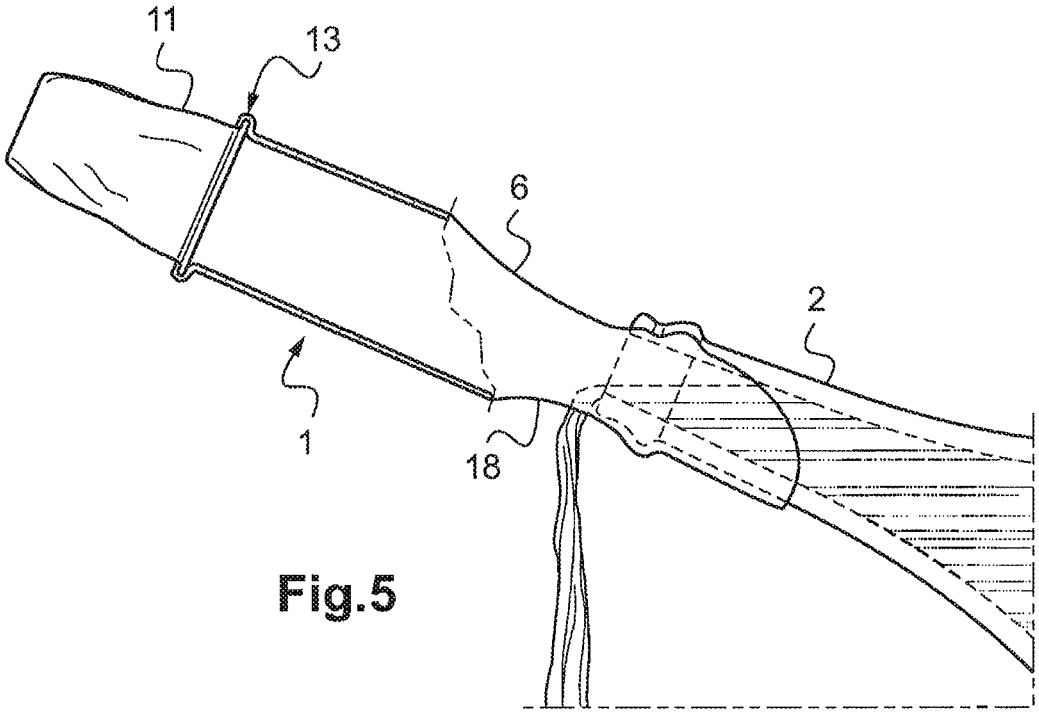
FIG. 5 shows a perspective view, of the set formed by the uncorking device and the bottle after disengagement of the cork.

With reference to FIG. 5, showing a perspective view of the set formed by the uncorking device 1 and the bottle 2 after the disengagement of the cork 3, it is shown that the lower portion 5 of the main body 4 further comprises a second opening 18.

This second opening 18 is interesting because it constitutes a passage allowing to pour the liquid without removing the uncorking device 1. It is thus possible to pour the liquid into a glass without having to remove the cork 3 out of the device 1.

The uncorking device 1 thus allows effectively and safely uncorking a bottle of a pressurized liquid by carrying out a damping and a retaining of the ejected cork.

It further ensures a great comfort of use both on the placement of the device 1 on the bottle and on its grip or thanks to the possibility of keeping the device 1 on the bottle while pouring the liquid.

Of course, other features of the invention might also have been considered without departing from the scope of the invention defined by the claims below.

By way of example, in a variant, the damping means 10 are constituted of a simple pocket fastened unremovably, without a seal. The user making sure before each use that the pocket is in place at the bottom of the main body 4 in order to be able to dump the stroke of the cork 3.

The invention claimed is:

1. An uncorking device of a bottle of a pressurized liquid with a cork in a mouth of the bottle, the device comprising:

a hollow main body of a substantially cylindrical section comprising:

a lower portion including an opening configured to receive the mouth of the bottle, and having a profile configured to clip the lower portion on a ring of the bottle;

an intermediate portion configured to facilitate grasping of the device and to guide the cork ejected into the main body; and an upper portion including a damper configured to dampen and to retain the cork after extraction thereof;

wherein the damper includes a deformable damping pocket disposed in the main body on an ejection path of the cork and whose deformation is performed in the main axis direction of the main body;

a blocker configured to block the damping pocket and the cork; and wherein said blocker includes a rim formed in the inner wall of the main body and a retaining ring between which a collar of the damping pocket is held so as to stop the set constituted by the damping pocket and the cork during the impact of the cork.

2. The uncorking device of a bottle of a pressurized liquid according to claim 1, wherein the damping pocket is a flexible pocket equipped with a seal opposite a point of impact of the cork, wherein said seal is tearable so as to release content of the damping pocket during the impact of the cork on said damping pocket.

3. The uncorking device of a bottle of a pressurized liquid according to claim 2, wherein the seal comprises at least one break line configured to tear during the impact of the cork.

4. The uncorking device of a bottle of a pressurized liquid according to claim 2, wherein the damping pocket contains ejectable materials or ejectable articles.

5. The uncorking device of a bottle of pressurized liquid according to claim 4, wherein the ejectable materials comprise confetti-type materials.

6. The uncorking device of a bottle of a pressurized liquid according to claim 1, wherein the retaining ring is fastened to the main body in a removable link allowing the replacement of the damping pocket.

7. The uncorking device of a bottle of a pressurized liquid according to claim 1, wherein the lower portion of the main body comprises a second opening configured to form a passage configured to convey poured liquid without removal of the uncorking device.

8. The uncorking device of a bottle of a pressurized liquid according to claim 1, wherein the main body is made of a deformable material facilitating contact between the lower portion and the neck of the bottle.

9. The uncorking device of a bottle of a pressurized liquid according to claim 1, wherein the main body is made of starch-based polymer.

* * * * *